US009290297B2

(12) United States Patent
Overath

(10) Patent No.: US 9,290,297 B2
(45) Date of Patent: Mar. 22, 2016

(54) THERMALLY INSULATING TRANSPORTATION BOX

(75) Inventor: Udo Overath, Lohmar (DE)

(73) Assignee: OVERATH GmbH, Lohmar (DE)

( * ) Notice: Subject to any disclaimer, the term of this patent is extended or adjusted under 35 U.S.C. 154(b) by 1600 days.

(21) Appl. No.: 11/887,854

(22) PCT Filed: Apr. 6, 2006

(86) PCT No.: PCT/EP2006/003123
§ 371 (c)(1),
(2), (4) Date: Dec. 30, 2008

(87) PCT Pub. No.: WO2006/105962
PCT Pub. Date: Oct. 12, 2006

(65) Prior Publication Data

US 2009/0206095 A1 Aug. 20, 2009

(30) Foreign Application Priority Data

Apr. 6, 2005 (DE) ..... 20 2005 005 472 U
Aug. 12, 2005 (DE) ..... 20 2005 012 738 U

(51) Int. Cl.
*B65D 6/00* (2006.01)
*B65D 6/18* (2006.01)
*B65D 21/02* (2006.01)
*B65D 81/38* (2006.01)

(52) U.S. Cl.
CPC ..... *B65D 11/1833* (2013.01); *B65D 21/0222* (2013.01); *B65D 81/3816* (2013.01)

(58) Field of Classification Search
USPC ..... 220/4.28, 592.2, 771, 7, 4.29, 531, 836, 220/848, 592.25, 844, 826; 206/509; 16/260
See application file for complete search history.

(56) References Cited

U.S. PATENT DOCUMENTS

| | | | | |
|---|---|---|---|---|
| 3,497,908 | A * | 3/1970 | Zamarra | 16/257 |
| 4,624,381 | A | 11/1986 | Friedrich | |
| 5,139,153 | A * | 8/1992 | Delamare et al. | 206/594 |
| 5,876,813 | A * | 3/1999 | Bambara et al. | 428/36.5 |
| 5,896,641 | A * | 4/1999 | Yamada et al. | 29/455.1 |
| 6,070,721 | A * | 6/2000 | Levitan | 206/308.1 |
| 6,155,479 | A * | 12/2000 | Wellner et al. | 229/117.08 |
| 6,189,330 | B1 * | 2/2001 | Retallick et al. | 62/371 |
| 2004/0222222 | A1 * | 11/2004 | Parnall et al. | 220/6 |
| 2005/0189404 | A1 * | 9/2005 | Xiaohai et al. | 229/103.11 |

FOREIGN PATENT DOCUMENTS

| | | |
|---|---|---|
| DE | 19713691 | 10/1998 |
| DE | 20002541 | 4/2000 |
| DE | 20311166 | 10/2003 |
| DE | 202004008227 U1 | 9/2004 |
| GB | 2257422 | 1/1993 |

* cited by examiner

*Primary Examiner* — Jeffrey Allen
(74) *Attorney, Agent, or Firm* — Pauley Erickson & Kottis

(57) ABSTRACT

A thermally insulating transportation box, including a base part, two longitudinal side parts, two transverse side parts and at least one top part, which parts bound a transportation space and are produced from a thermally insulating material. The longitudinal side parts and the transverse side parts are pivotably mounted on the base part about pivot axes which each run parallel to the base part, so that they can be folded open from a folded-together arrangement, which extends parallel to the base part, into an arrangement which is perpendicular to this and in which they bound the transportation space, and the transportation space can subsequently be closed by the at least one cover part.

22 Claims, 8 Drawing Sheets

THERMALLY INSULATING TRANSPORTATION BOX

BACKGROUND OF THE INVENTION

1. Field of the Invention

This invention relates to a thermally insulating shipping container including a bottom piece, two longitudinal side pieces, two transverse side pieces and at least one cover piece, which enclose a shipping chamber and are made of an insulating material.

2. Discussion of Related Art

Thermally insulating shipping containers are known and are extensively used, for example, for shipping temperature-sensitive foods, such as frozen food, or also for shipping warm food. For the purpose of efficient and cost-effective production, along with good thermal insulation properties, such shipping containers are often integrally produced from a molded particle foam on the basis of a polyolefin, such a polypropylene, so-called EPP, or also on the basis of polystyrene, so-called EPS.

However, in connection with known shipping containers, it has been found to be disadvantageous that, because of their integrally one-piece manufacture, they are very bulky when not in use and thus require a large shipping volume.

On the other hand, shipping containers are known which do not have a thermally insulating function and which, when not in use, can be folded in a space-saving manner. However, the folding mechanisms employed cannot be transferred to the previously discussed thermally insulating shipping containers, because the hinged connections, which customarily comprise hinged shafts and hinged bearings for the foldable connection of the individual parts, cannot be applied to or embodied as foamed EPP or EPS parts.

SUMMARY OF THE INVENTION

One object of this invention is to provide a thermally insulating shipping container of the type mentioned above but which has good insulation properties and occupies only a small volume when not in use, is easy to manufacture and has a large carrying capacity and stability in the unfolded state.

To attain the object, this invention relates to a thermally insulating shipping container having characteristics described in this specification and in the claims.

In accordance with this invention, the longitudinal side pieces and the transverse side pieces are pivotably maintained on the bottom piece around respective pivot axes, which extend parallel with respect to the bottom piece, so that they can be unfolded from a folded orientation, which extends parallel with respect to the bottom piece, into an orientation which is perpendicular to it, in which they enclose the shipping chamber and in which the shipping chamber can be subsequently closed by the at least one cover piece. Thus, in accordance with this invention, a bottom piece is proposed as a central element, on which the longitudinal and transverse side elements are pivotably fastened or maintained, such as all connecting elements required for this can be integrated into the bottom piece and correspondingly in the longitudinal and transverse side pieces, which leads to a particularly sturdy shipping container in the unfolded state.

In one embodiment of the shipping container in accordance with this invention, the bottom piece has a right-angled bottom area, wherein a corner protrusion, whose top projects upward, is formed in each corner area of the bottom piece. On its sides facing the longitudinal and transverse side pieces, each one of the corner protrusions has integrally molded hinge elements, which can be brought into an operational connection with correspondingly formed hinge elements of the longitudinal and transverse side walls. Accordingly, the corner protrusions of the bottom piece provide holding and pivotable linkage of the longitudinal and transverse side pieces at the bottom piece. Also, the corner protrusions can also be used as stops for the longitudinal and transverse side pieces brought into an unfolded position, for example placed perpendicularly with respect to the bottom piece, so that further unfolding is prevented by a stop against the corner protrusions, and a dimensionally stable shipping container is created.

In order to continue to be able to produce the thermally insulating shipping container in accordance with this invention with an efficient mode of production from a molded particle foam, the hinge elements are preferably integrally molded in the bottom piece and the longitudinal or transverse side walls.

In one embodiment of this invention, the longitudinal and transverse side walls are in the form of spherical heads or universal ball joint-shaped heads, which are maintained, pivotable around the hinge axes, in correspondingly embodied ball sockets provided, for example, in the area of the corner protrusions. However, the opposite arrangement is also possible, such as the ball sockets are integrally molded in the longitudinal and transverse side walls, while the corresponding spherical heads seated therein are molded in the bottom piece, preferably in the area of the corner protrusions. It is thus possible to omit additional parts, such as hinge shafts, which possibly require different materials.

It is also possible to provide heads in the shape of a truncated cone and corresponding linkage recesses in place of heads in the shape of a universal ball joint.

Not employing other materials does not only make sense from the viewpoint of economy of manufacture, because in this case additional assembly steps are saved. Further, the omission of additional materials makes possible recycling of only one type, or the easy disposal of a no longer required shipping container in accordance with this invention.

In one embodiment of this invention, the at least one cover piece can be placed on top of the unfolded longitudinal and transverse side pieces for closing the shipping chamber at the top. The shipping container in accordance with this invention has additional stiffening by the cover piece which, in the unfolded orientation of the longitudinal and transverse side pieces, can be placed on top of it, so that its sturdiness in the unfolded state approaches that of a shipping container formed in one piece.

Two cover pieces are provided in another possible embodiment of this invention, which together provide the closure at the top of the shipping chamber. Particularly advantageously, it is possible to provide pivotable fixation of each cover piece on one of the transverse side pieces, so that the cover pieces are not only connected with the further parts of the shipping container in accordance with this invention in a way in which they cannot be lost, but that, in the folded state of the transverse side pieces, they can also be folded in a space-saving manner above or below the transverse side pieces in a parallel orientation with respect to the latter.

Here, the cover pieces can be maintained, pivotable around hinge axes, on the transverse side pieces by linkage heads held in hinge elements in the form of hinge recesses, wherein the hinge elements are respectively integrally molded in the cover pieces and the transverse side pieces. For example, the linkage heads can have the shape of universal ball joints or truncated cones. In this way, the shipping container in accordance with this invention also makes do without additional hinge pieces, such as shafts, bushings, and the like and can be produced true-to-type, for example by known molded foam methods, in a single work step.

Within the framework of this invention, exterior carrying handles can be on the longitudinal and/or transverse side walls of the shipping container in accordance with this invention, to cause the user to carry and handle the shipping container in accordance with this invention, along with its possibly considerable filling weight, at defined locations which are particularly suitable for the transfer of force.

In accordance with a suggestion of this invention, it is possible to provide attachment strips, which respectively protrude at the top from the bottom piece, between two adjoining corner protrusions used for the hinged holding of longitudinal or transverse side walls, which strips are provided on their sides facing the respective corner protrusions with corresponding hinge elements, such as with the corner protrusions. Accordingly, the hinge elements are used to come into operational connection with correspondingly formed hinge elements of the longitudinal or transverse side walls, so that a particularly large degree of stability is achieved by this dual joint connection, and the longitudinal and transverse side walls are prevented from being released in an undesired manner from the hinge connection, even if a large load is absorbed inside the shipping container.

In accordance with a further embodiment of this invention, the longitudinal side walls are equipped with means for the snap-in reception of the transverse side walls in the unfolded orientation. Accordingly, if the shipping container in accordance with this invention is raised into its position of use by successively occurring unfolding of the longitudinal side walls and the transverse side walls, further increased stability is achieved by the snapped-in reception of the unfolded transverse side walls between the longitudinal side walls, wherein this snapped-in orientation of the longitudinal and transverse side walls can only be cancelled by a definite use of force, but is safe from accidental folding.

Also, the longitudinal and/or transverse side walls can be embodied with insertion strips which, in the unfolded orientation, are arranged at the top and can be inserted into corresponding insertion grooves formed at the bottom of at least one cover piece, so that the at least one cover piece can be positively attached to the top of the longitudinal and transverse side walls arranged in the unfolded orientation, and the cover piece is not only maintained secure against loss, but a positive connection, which increases the stability of the shipping container, is also achieved.

Other snap-in and locking options of the at least one cover piece on the longitudinal and transverse side walls arranged in an unfolded orientation are also possible within the framework of this invention. Within the framework of this invention, it is also possible to maintain the cover piece pivotably on the longitudinal and transverse side walls, wherein in such embodiments the cover piece can be of several pieces.

For arranging the shipping container in accordance with this invention and its individual parts as a compact unit also in the folded state, and to protect it from damage, the height of the corner protrusions extending in height above the bottom surface of the bottom piece is preferably of such a size, that at least the lateral side walls and the longitudinal side walls can be received in a parallel orientation with respect to the bottom piece between these corner protrusions. In this orientation the upper edge of the corner protrusions terminates flush with the cover piece placed on the longitudinal and transverse side walls.

The shipping container of this invention can preferably be produced from a molded particle foam, known per se, which has a particularly good thermal insulating effect and has a predominantly closed-cell foam structure, on the basis of a polyolefin, such as polyethylene or polypropylene, or on the basis of polystyrene. However, other material selections are also possible within the framework of this invention.

However, it is preferable if the shipping container is made of molded foam particles of an apparent density of at least 30 $kg/m^3$, wherein the wall thickness of the bottom piece, the longitudinal and transverse side pieces and the cover piece should be in the range between 15 to 35 mm, preferably 25 to 30 mm.

In an alternative embodiment of the shipping container in accordance with this invention, if from molded parts, containing hollow chambers, on the basis of thermoplastic materials, can be produced in a cost-effective manner, and can have a great insulating effect because of their hollow chambers that are extremely sturdy. In such embodiment of the shipping container in accordance with this invention of molded parts, wall thicknesses of approximately 0.5 to 2 mm are preferably provided, if the molded parts are made of polypropylene. Such molded parts can be produced, for example, by a blow-molding method, wherein the hinge elements can also be integrally molded.

Also, the surfaces of the shipping container in accordance with this invention can have a liquid-proof coating, for example a foil, which is placed into the tool during the molded foam process and is integrally connected with the molded foam particles and that then forms the surface of the produced molded parts. A shipping container in accordance with this invention, produced from such surface-coated parts, can be easily washed off if dirty and, with an appropriate shaping of the bottom piece, can also form a leak-proof catch basin for liquid possibly exiting the materials shipped in the shipping chamber.

BRIEF DESCRIPTION OF THE DRAWINGS

Further embodiments and details of this invention will be explained in greater detail in view of an exemplary embodiment shown in the drawings, wherein.

DETAILED DESCRIPTION OF THE INVENTION

Figure 1A:
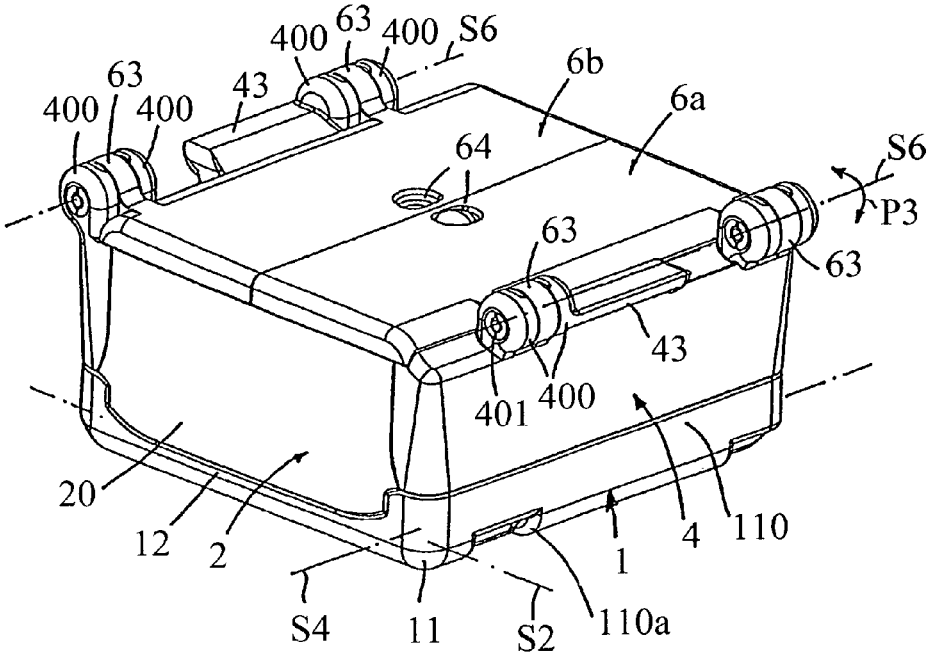
FIG. 1*a* is a perspective view of a first embodiment of the shipping container in accordance with this invention, in the unfolded state.

A thermally insulating shipping container is represented in FIGS. 1 to 6, which includes a bottom piece 1, two longitudinal side pieces 2, two transverse side pieces 4 and a two-piece cover piece 6*a*, 6*b*, which can be placed, parallel with the bottom piece 1, on the longitudinal and transverse side pieces 2, 4, so that in the position of use a shipping chamber is enclosed.

The thermally insulating effect of the shipping container is a result of the above mentioned pieces being produced from a thermally insulating material, for example EPP of an apparent density of at least 30 kg/m$^3$ and a wall thickness of preferably 25 to 30 mm and with a predominantly closed-cell foam structure.

Figure 1B:
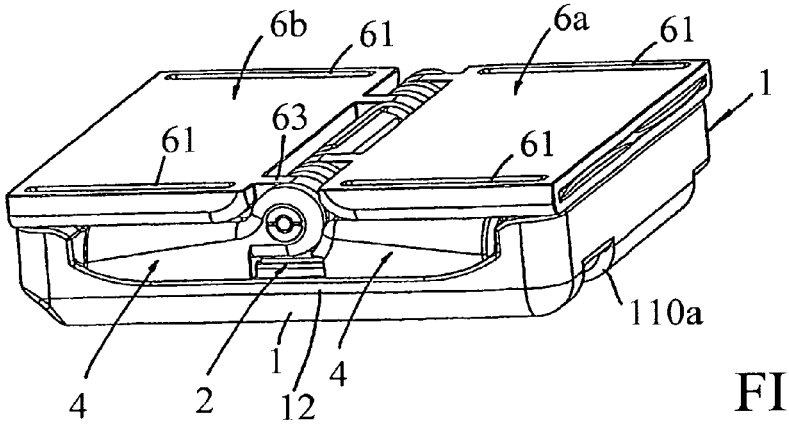
FIG. 1*b* is a perspective view of the shipping container in accordance with FIG. 1, in the folded state.

The shipping container represented in the drawing figures during non-use can be folded together in a space-saving manner, as shown in FIG. 1*b*, and can be unfolded for use, as will be explained in greater detail in this specification and as shown in FIG. 1*a*.

Figure 2:
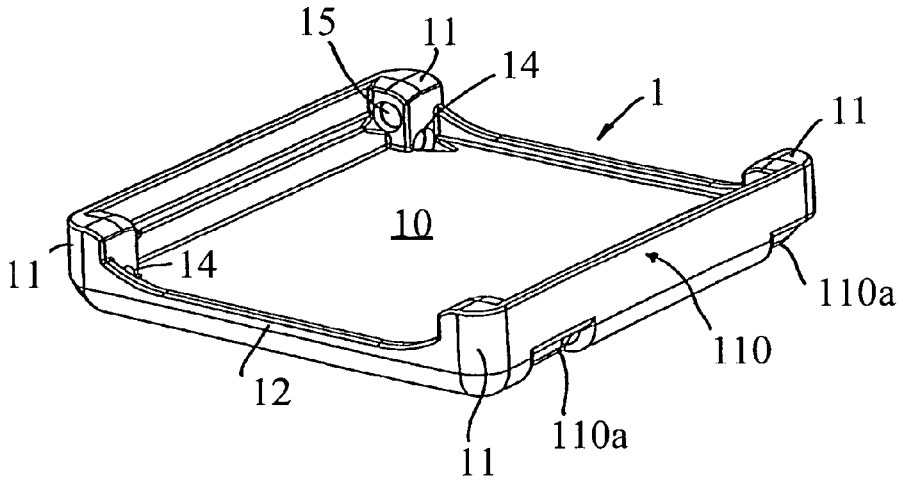
FIG. 2 is a perspective view of the bottom piece of the shipping container, in accordance with FIGS. 1*a* and 1*b;*

The basis, or the basic element of the shipping container is the bottom piece 1, whose details are shown in FIG. 2.

The bottom piece 1 has a rectangular bottom area 10, wherein an upwardly projection corner protrusion 11 is molded in each corner area of the bottom piece 10.

Figure 4:
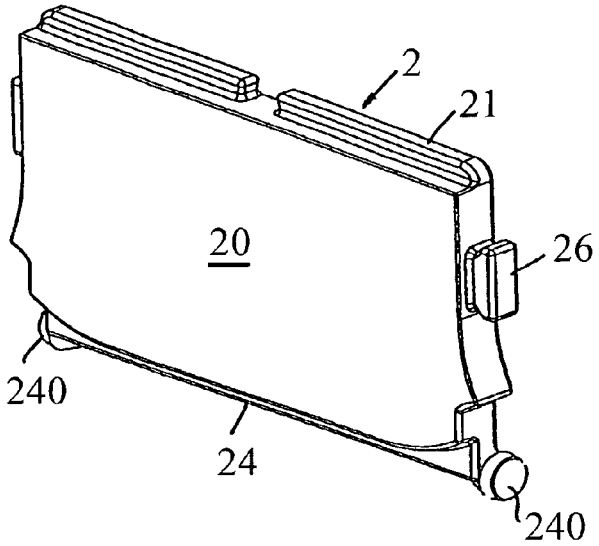
FIG. 4 shows a longitudinal side piece of the shipping container in accordance with FIGS. 1*a* and 1*b*, in a perspective view.

Two attachment strips, shaped in the manner of stair steps and projecting from the top and identified by the reference numeral 12, can be seen between adjoining corner protrusions 11 along oppositely located edge areas of the bottom piece 10. The edge areas of the bottom piece 10 containing the attachment strips 12 face the longitudinal side pieces 2, the closer details of one of which are shown in FIG. 4.

Now, in order to assure a foldable or unfoldable orientation of the longitudinal and transverse side pieces 2 and 4 on the bottom piece 1, such as shown in FIG. 1*a* or 1*b*, each corner protrusion 11 of the bottom piece 1 has hinge elements in the form of spherical or half-shell-shaped linkage recesses, which can also be called ball sockets 14, 15, on its sides facing the longitudinal or transverse side pieces 2, 4. Here, the ball sockets identified by the reference numeral 14 face the longitudinal side wall 2, for example they are molded in the corner protrusions 11 in the direction of the attachment strips 12 of the bottom piece 1, while the ball sockets identified by the reference numeral 15 face the transverse side walls 4 and are molded at right angles with respect to the ball sockets 14 in the corner protrusions 11.

One essential characteristic of these hinge elements in the form of ball sockets 14, 15 is that they are integrally molded in the corner protrusions 11, so that the one-piece manufacture of the bottom piece 1, such as shown in FIG. 2, of the shipping container by a molded foam process of expanded polypropylene particle foam or expanded polystyrene (EPP or EPS) is made possible without requiring additional materials or individual parts.

For being pivotably held on the bottom piece 1 embodied in this way, the longitudinal side walls 2, such as shown in FIGS. 4*a* and 4*b*, are embodied with a hinge strip 24 which, in the unfolded orientation, is arranged on the underside and extends past or beyond the lateral face 20. Corresponding to the ball sockets 14 provided for this, half-shell-shaped or universal ball joint-shaped spherical heads 240, which project from the corner protrusions 11 and can be inserted into oppositely located ball sockets 14 of adjoining corner protrusions 11 parallel with an attachment strip 12, are integrally molded on the hinge strip 24 at the two front ends of the hinge strip 24 on the underside. Therefore the longitudinal side pieces 2, together with their hinge elements in the form of spherical heads 240, can also be produced in one piece, for example by a molded foam process.

Figure 3A:
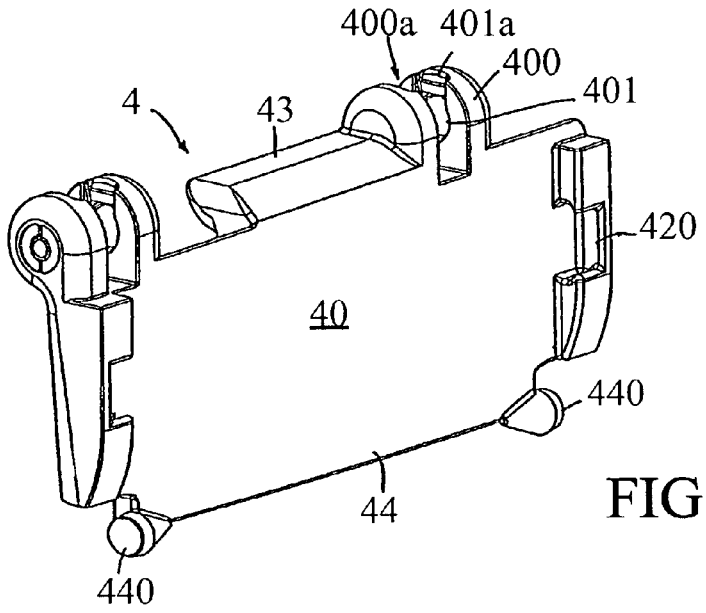
FIG. 3*a* is a perspective view of the transverse side piece of the shipping container in accordance with FIGS. 1*a* and 1*b;*
Figure 3B:
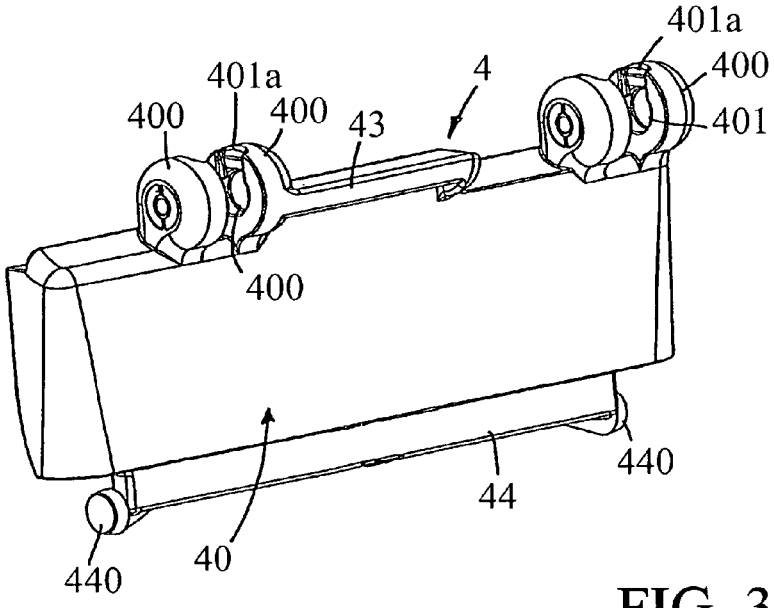
FIG. 3*b* is a perspective view of the transverse side piece in accordance with FIG. 3*a* in a further perspective representation.
Figure 5:
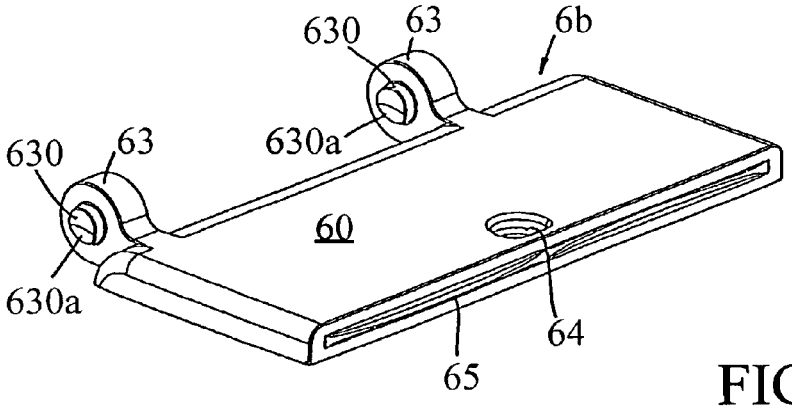
FIG. 5 shows a cover piece of the shipping container in accordance with FIGS. 1*a* and 1*b*, in a perspective view.

In the same way, the transverse side pieces 4 shown in FIGS. 3*a* and 3*b* are embodied with a hinge strip 44 which, in the unfolded orientation, projects on the underside past the lateral face 40 and has a lesser width, which again has half-shell-shaped spherical heads 440 as hinge elements on its two front ends, which can be inserted into correspondingly provided ball sockets 15 between two adjoining corner protrusions 11 of the bottom piece 1.

As shown in FIG. 2, the ball sockets 15 used for receiving the spherical heads 440 of the transverse side pieces 4 can be arranged with respect to the bottom area 10 of the bottom piece at a greater height than the ball sockets 14 used for receiving the spherical heads 240 of the longitudinal side pieces 2, and thus as can be seen in FIG. 1*b*, can arrange the two longitudinal side pieces 2 on the bottom area 10 in a folded orientation, such as extending parallel with respect to the bottom piece 1 and its bottom area 1Q, and to also arrange thereon the two transverse side pieces 4, also in a parallel orientation with respect to the bottom area 10 of the bottom piece 1. Then it is possible to place the cover pieces 6*a* or 6*b*, visible in FIG. 5, on this arrangement of transverse side pieces 4 and longitudinal side pieces 2, wherein the height of the corner protrusions 11 is preferably selected so that they then terminate flush with the top of the folded-up transverse side pieces 4, and the transverse side pieces 4 and the longitudinal side pieces 2 are received between the corner protrusions 11. In this folded orientation, the shipping container in accordance with FIG. 1*b* needs only little storage space.

If used in accordance with its purpose, for example to enclose a shipping chamber in which temperature-sensitive material can be shipped, the longitudinal and transverse side pieces 2, 4 are placed into a folded-open position, which can be seen in FIG. 1*a*. First, starting with the folded state in accordance with FIG. 1*b*, the transverse side pieces 4 with the cover pieces 6*a*, 6*b*, which are fastened on them in a manner yet to be described, are raised into a vertical position. In the process, unfolding takes place around a pivot axis S4, which is defined by the hinge elements in the form of the ball sockets 15 and the spherical heads 440 and extends at right angles in relation to the pivot axis S2 of the longitudinal side pieces 2.

Now the longitudinal side pieces 2 can be reached, which are accessible above the bottom piece 1 and are in the folded-up orientation, such as extending parallel with the bottom area 10. Because of their pivotable seating between the ball sockets 14 of the corner protrusions 11 and the spherical heads 240, they are now raised on the hinge strips 24 of the side pieces 2 around a pivot axis identified by S2 into an orientation extending vertically with respect to the bottom area 10 of the bottom piece 1, in which, with a contact protrusion 2*a* on their underside, they come into contact with the respective attachment strip 12, so that they assume an exactly right-angled orientation with respect to the bottom piece 1.

It is understood that the respective heights of the longitudinal and transverse side pieces 2, 4 in the unfolded state should be matched, i.e. should be identical, and the heights should be selected so that the oppositely located longitudinal side walls 2 or transverse side walls 4 can be folded completely over the bottom piece 1.

Figure 6:
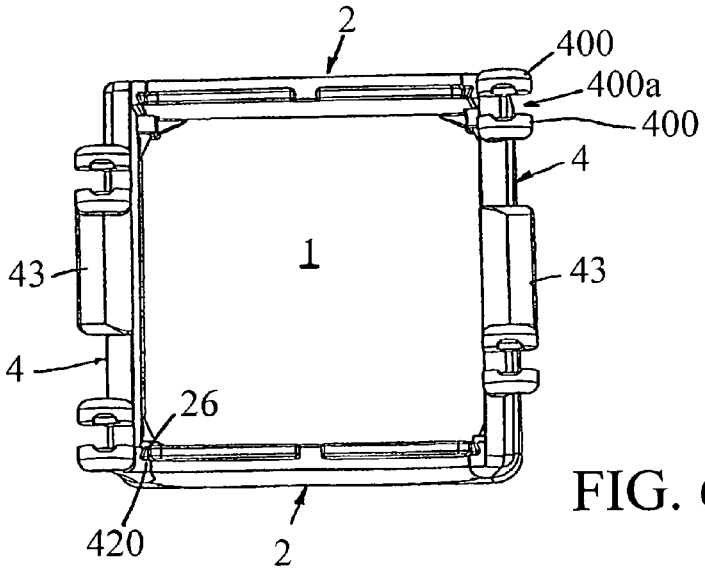
FIG. 6 shows a top view from above on the shipping container with the cover pieces removed.

After the longitudinal and transverse side pieces 2, 4 thus designed are brought into their unfolded orientation, such as extending vertically with respect to the bottom area 10 of the bottom piece 1, the shipping container in accordance with FIG. 6 can be filled and, following this, the cover pieces 6*a*, 6*b* can be placed on the top edge areas of the side pieces 2, 4, in order to close the shipping chamber inside the shipping container. For this purpose, the longitudinal side walls 2 have top insertion strips 21 along their edge areas which are on top in the unfolded orientation, which strips positively engage correspondingly designed grooves 61 on the underside of the cover piece 6, in the cover pieces 6*a*, 6*b* as shown in FIG. 1*b*. A shipping container unfolded in this way and plugged together by positive connections has extremely high sturdiness and stability and can be used for shipping even heavy sensitive materials.

Moreover, all performed positive locking processes and also the pivot movements are reversible, i.e. following its use the shipping container can again be folded into its folded, space-saving orientation as shown in FIG. 1*b*, and is therefore suitable for repeated or returnable use.

Although it would be possible to only provide a single cover piece which can be applied and removed, the shipping container preferably has a multi-section cover piece, comprising two cover pieces 6*a*, 6*b*, wherein the two cover pieces 6*a*, 6*b* each cover approximately one-half of the shipping chamber in the interior of the shipping container and together cover it on the top in the orientation shown in FIG. 1*a*.

Also, the two cover pieces 6*a*, 6 are pivotably held on the horizontal edge of the transverse side pieces 4 which lie on top in the folded-open state of the transverse side pieces 4.

For this purpose, each pair of transverse side pieces 4, whose greater details can also be seen in FIGS. 3*a* and 3*b* and which, in their folded-open state, lie on top, has hinge receptacles 400, which are each spaced apart by an interspace 400*a*.

Linkage recesses 401 are integrally formed out of the facing inner surfaces of the respective pairs of hinge receptacles 400 which, for defining an insertion channel, are upwardly widened in the shape of a step or in the shape of a ramp, which is indicated by the reference numeral 401*a*.

Correspondingly, the two cover pieces, for example the cover piece 6*b* shown in FIG. 6, have a hinge element 63, which is integrally molded on the cover piece 6*b* and fits into the interspace 400*a* and on whose two sides facing the linkage recesses 401 protruding linkage heads 630 of a truncated-cone shape are molded, so that, without the addition of separate hinge elements, a pivotable seating of the two cover pieces 6*a*, 6*b* on the transverse side pieces 4 can be provided by the integral shaping of the hinge elements formed in this way. A ramp-shaped flattening 630*a* is provided for easy introduction of the linkage heads 630 into the linkage recesses which, together with the insertion channels 401*a*, makes possible the easy attachment and, if required, also the removal, of the cover pieces 6*a*, 6*b*.

The hinge connection realized in this process between the transverse side pieces 4 and the respective cover pieces 6*a*, 6*b* defines pivot axes S6 parallel with respect to the pivot axes S4 of the transverse side pieces 4, which assure the pivotability of the cover pieces 6*a*, 6*b* by at least 270°.

Because of this great pivot angle it is not only possible, as shown in FIG. 1*a*, to place the cover pieces 6*a*, 6*b* on the upper edge area of the longitudinal and transverse side pieces 2, 4 for closing the shipping chamber, but also to fold them open for access to the shipping chamber which is made easier by forming out grip recesses 64 on the top of the cover pieces 6*a*, 6*b*.

If, for the purpose of returning or because of non-use, the shipping container thus designed, as shown in FIG. 1*b*, first, following the folding open of the cover pieces 6*a*, 6*b*, folding of the longitudinal side pieces 2 into an orientation extending parallel with respect to the bottom piece 1 is provided in the already explained way by the pivotable seating of the transverse side pieces 4 around the pivot axis S2 on the bottom piece 1. Thereafter, the two cover pieces 6*a*, 6*b* are brought out of their position represented in FIG. 7*a* into a parallel position with respect to the transverse side pieces 4, which are still in the unfolded state, on the two facing outsides of the same and, as a result of their already mentioned pivotable seating around the pivot axis S4, subsequently the transverse side pieces 4 are brought into their position which is shown in FIG. 1*b*, in which they come to rest in a space-saving manner parallel with the previously folded-in longitudinal side pieces 2 and the bottom piece 1. The cover pieces 6*a*, 6*b* rest above and parallel with the transverse side pieces 4.

As shown in FIGS. 1*a* and 2, in an edge area between the corner protrusions 11 facing the transverse side pieces 4, the bottom piece 1 has a raised attachment edge 110, which assures an exact right-angled placement of the transverse side pieces 4 in the folded-open state.

In order to urge the user to grasp the shipping container at the transverse side pieces 4 connected in this way in a positive manner with the bottom piece 1, the carrying handles identified by the reference numeral 43 are integrally molded on the outside of the transverse side pieces 4 between the respective hinge receptacles 400. Finally, the representation of the longitudinal side piece 2 in accordance with FIG. 4 shows the forming of snap-in pins 26 which, in the folded-open state of the longitudinal side pieces 2, engage corresponding recesses 420 in the transverse side pieces 4 and assure a great sturdiness of the shipping container, such as shown in FIGS. 3*a* and 6.

Because the bottom piece 1, of the above explained embodiment in accordance with FIG. 2, has an edge running around the top, formed by the attachment strips 12, 110, it is also used as a catch basin for liquid possibly exiting the shipped material in the shipping chamber. With an appropriate dimensioning of the encircling edge it is possible, for example, to assure a capacity of 1 l of liquid or more inside the bottom piece 1.

It is a substantial characteristic of the shipping container that all individual pieces, including their functional elements, in particular the hinge elements, can be molded integrally from a particle foam without the use of separate individual parts, which makes possible a shipping container which is true-to-type and cost effective, but is extremely sturdy. Here, all linkage heads used can have the shape of a truncated cone or universal ball joint, and all linkage recesses a shape matching this.

Figure 7:
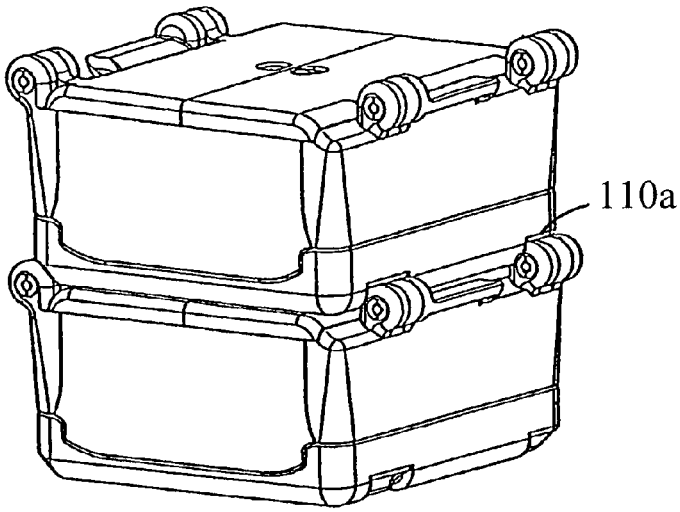
FIG. 7 shows a perspective view of two shipping containers stacked on top of each other, each in the unfolded state, in accordance with FIG. 1*a;*
Figure 8:
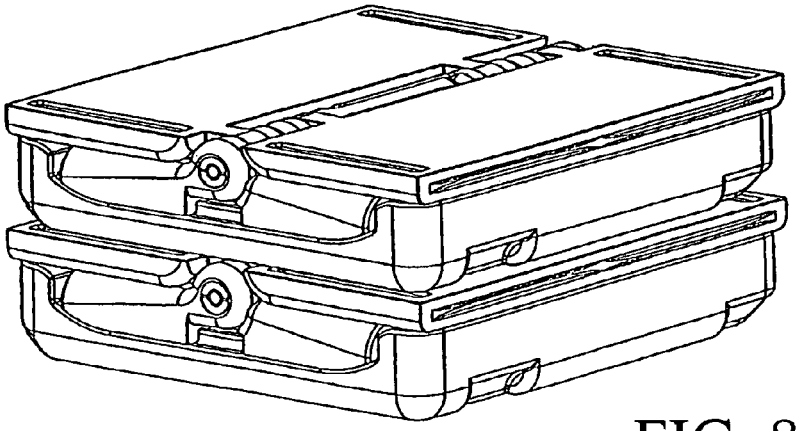
FIG. 8 shows a perspective view of two shipping containers stacked on top of each other, each in the folded state, in accordance with FIG. 1*b;*

Finally, the bottom piece 1 also has outside recesses 110*a* which are designed corresponding to the hinge connections between the transverse side pieces 4 and the cover pieces 6*a*, 6*b*, so that several shipping containers can be stacked on top of each other, secure against slipping, in the unfolded state, see FIG. 7, as well as in the folded state, as shown in FIG. 8.

Figure 9:
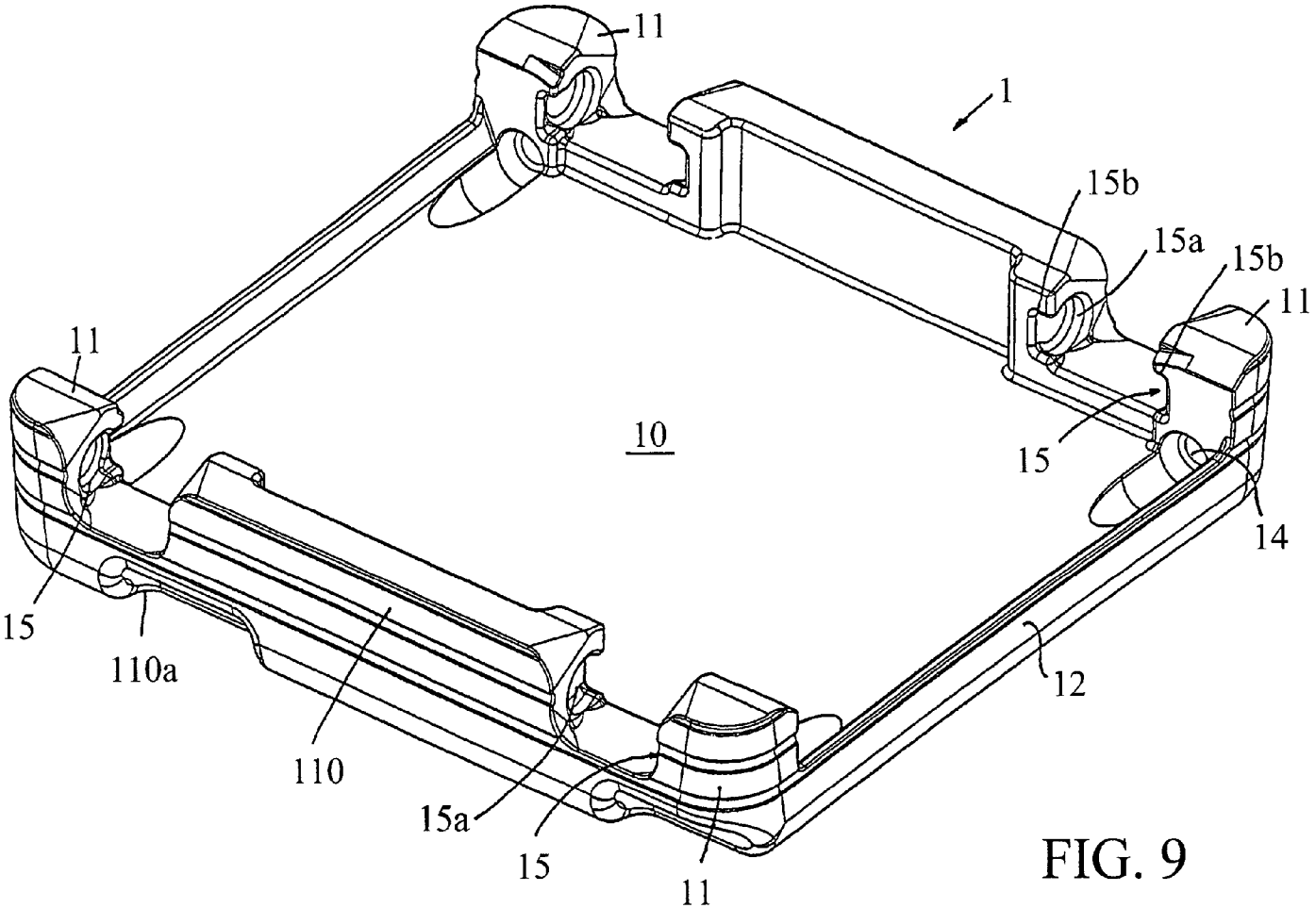
FIG. 9 shows a perspective view of a further embodiment of the bottom piece of a shipping container in accordance with this invention.
Figure 10:
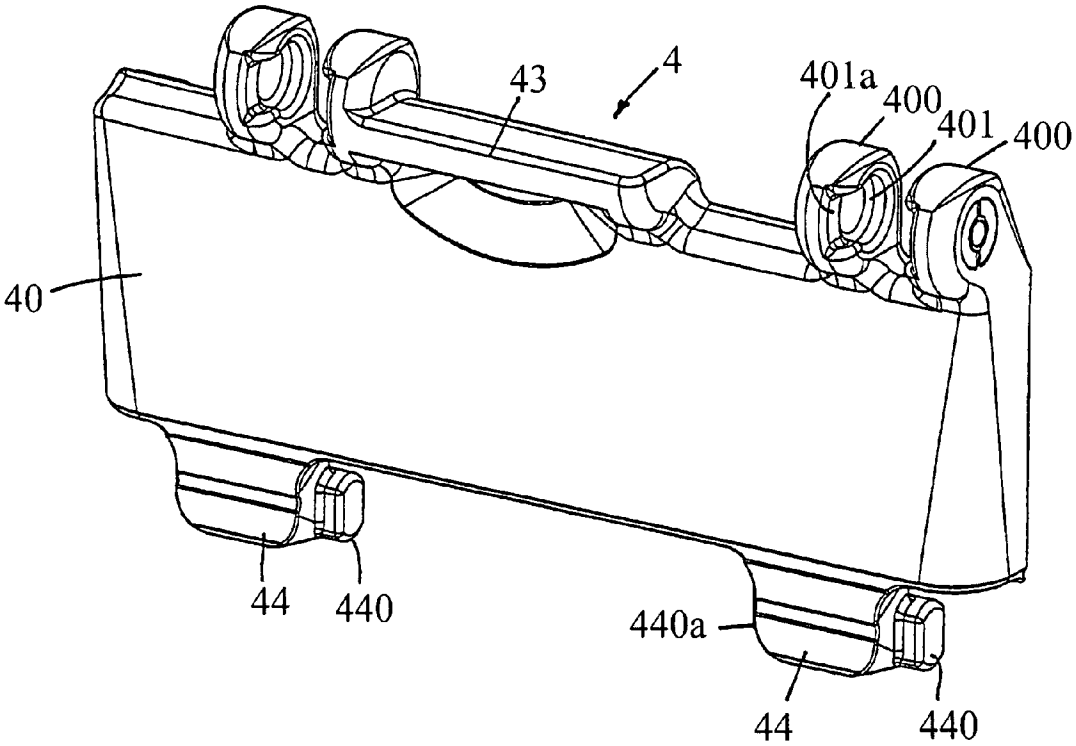
FIG. 10 shows a perspective view of a further embodiment of a transverse side piece of a shipping container in accordance with this invention.
Figure 11:
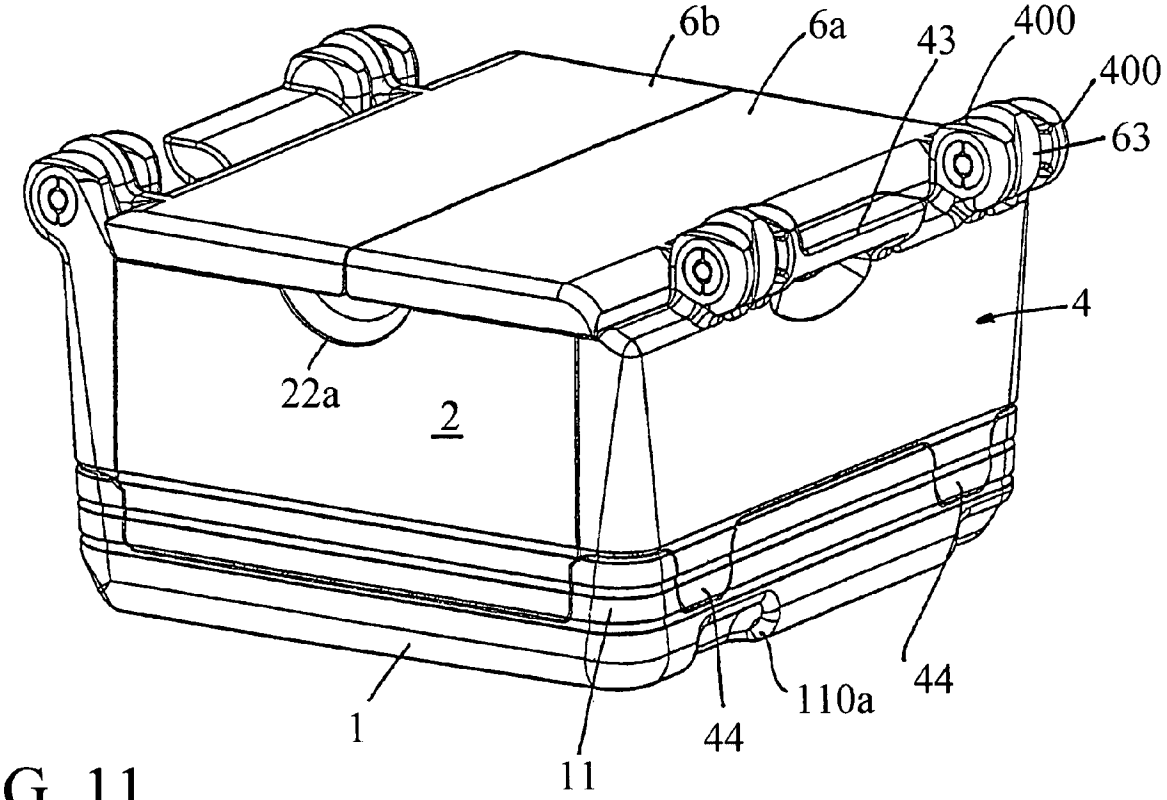
FIG. 11 shows a perspective view of a further embodiment of the shipping container in accordance with this invention with pieces in accordance with FIGS. 9 and 10.

A further possible embodiment of the shipping container is shown in FIGS. 9 to 11, wherein like elements have the same reference numerals as in the previously represented and described embodiments and will not be separately explained in what follows, provided this is not necessary for understanding this invention.

The shipping container represented in its position of use in FIG. 11 has a bottom piece 1 represented in greater detail in FIG. 9 and is equipped, as in the previously described embodiments, with an upwardly projecting corner protrusion 11 in each corner area.

In the area used for the pivotable fastening of a transverse side piece 4, a fastening strip 110, which upwardly projects past or beyond the bottom piece 1, is formed between the facing corner protrusions 11 and the hinge elements, identified by the reference numeral 15, in the corner protrusions, which strip, at the two ends located opposite the two corner protrusions 11, itself has corresponding hinge elements 15*a*, which are integrally molded and which correspond in their configuration to those of the recesses 15 in the corner protrusions 11. The respective insertion opening 15*b* for a hinge element of the transverse side piece 16 to be received in it, and which is shown in FIG. 10 by reference numerals 440, extends parallel with respect to the bottom area 10 of the bottom piece 1 and is identified by the reference numeral 15*b*.

As shown in the overview in accordance with FIG. 11, each transverse side piece 4, which also has the carrying handles 43 for carrying the shipping container, is doubly held on both sides of each formed-on hinge strip 44 by appropriately projecting hinge elements 440 in the corresponding hinge receptacle 15 or 15*a* of a corner projection 11 or fastening projection 110 and, in the folded-open position shown in FIG. 11, cannot be removed out of the receiving position, even in case of large loads arranged inside the shipping container. Thus, it is possible also with this embodiment to ship large loads inside the shipping container without the danger of the hinge connection between the bottom piece 1 and the transverse side piece 4 being overwhelmed.

As shown in the embodiment in accordance with FIG. 11, the recesses 22*a* are cut into the longitudinal side pieces 2, which are used as opening aids for the two cover pieces 6*a*, 6*b*.

A further functionality of the represented shipping container corresponds to the exemplary embodiment previously described in detail by FIGS. 1*a* to 8, so that it is possible to omit further functionality explanations to prevent repetitions.

It is understood that, in place of producing them from particle foam, each one of the previously explained embodiments of the shipping container in accordance with this invention can also be produced, for example, from molded parts made of a thermoplastic material, such as polypropylene or polyethylene, which have hollow chambers, are therefore especially light and at the same time thermally insulating. Such hollow-chambered molded parts can for example be produced in accordance with a blow-molding method, such as now known for producing panel parts for the automobile industry and the like.

The invention claimed is:

1. A shipping container comprising:

a shipping chamber enclosed by a bottom piece, two longitudinal side pieces, two transverse side pieces, and two cover pieces, each formed of molded foam particles of a predominantly closed foam structure;

the bottom piece including a plurality of corner protrusions, each of the corner protrusions including a first socket integrally formed in a first side and a second socket integrally formed in a second side;

each of the two longitudinal side pieces and two transverse side pieces including a pair of linkage heads each integrally molded of the molded foam particles at one of opposite side piece corners, each of the linkage heads inserted into a corresponding one of the first socket or second socket, wherein the longitudinal side pieces and the transverse side pieces are each pivotably maintained on the bottom piece around respective pivot axes which extend parallel with respect to the bottom piece, and are unfoldable from a folded orientation which extends parallel with respect to the bottom piece into an orientation which is perpendicular to the bottom piece to enclose the shipping chamber;

each of the longitudinal side pieces or each of the transverse side pieces including: a top edge opposite the pair of linkage heads, two hinge receptacles extending from the top edge and connecting to one of the cover pieces, and an exterior carrying handle element extending from the top edge and disposed between the two hinge receptacles, wherein the handle element is formed integral to a first of the two hinge receptacles and spaced apart from a second of the two hinge receptacles, the handle element is centered between first end of the top edge and a second end of the top edge, the first of the two hinge receptacles is connected to a first side of the handle element, and a space separates the second of the two hinge receptacles from a second side of the handle element;

wherein in the folded orientation the longitudinal side pieces or the transverse side pieces lie in same plane and the first of the two hinge receptacles of each of the longitudinal side pieces or the transverse side pieces is disposed in the space between the second of the two hinge receptacles and the handle of an other of the longitudinal side pieces or the transverse side pieces.

2. The shipping container in accordance with claim 1, wherein each of the linkage heads is shaped as a ball joint or a truncated cone, held in a correspondingly embodied ball socket.

3. The shipping container in accordance with claim 1, wherein the longitudinal side pieces (2) have a snap-in engagement with the transverse side pieces (4) in an unfolded orientation.

4. The shipping container in accordance with claim 1, wherein at least one of the longitudinal and the transverse side pieces (2, 4) have insertion strips (21) arranged on top in the unfolded orientation and are insertable into corresponding insertion grooves (61) formed on an underside of at least one cover piece (6*a*, 6*b*).

5. The shipping container in accordance with claim 1, wherein the corner protrusions (11) extending from the bottom area (10) of the bottom piece (1) have a height sized so that the transverse side pieces (4) and the longitudinal side pieces (2) are receivable between the corner protrusions (11) in parallel orientation with respect to the bottom piece (1).

6. The shipping container in accordance with claim 1, wherein at least one cover piece (6*a*, 6*b*) is plugged on the unfolded longitudinal and transverse side pieces (2, 4).

7. The shipping container in accordance with claim 1, wherein each of the two cover pieces (6*a*, 6*b*) is pivotably fastened to one of the transverse side pieces (4).

8. The shipping container in accordance with claim 1, wherein the bottom piece (1) forms a catch basin for liquid collecting in the shipping chamber.

9. The shipping container in accordance with claim 1, wherein the shipping container is made of molded foam particles of a predominantly closed foam structure of a polyolefin or a polyester.

10. The shipping container in accordance with claim 1, wherein surfaces of the shipping container have a liquid-proof coating.

11. The shipping container in accordance with claim 1, wherein the shipping container is made of molded foam particles of a predominantly closed foam structure of a polyethylene or a polypropylene.

12. The shipping container in accordance with claim 1, wherein the bottom piece has upwardly protruding fastening strips (12, 110) for attaching the folded-open at least one of longitudinal side pieces (2) and transverse side pieces (4).

13. The shipping container in accordance with claim 12, wherein the fastening strips (12, 11) are formed on the bottom piece (1) between adjoining corner protrusions (11) and have integrally molded hinge elements which can be brought into operational connection with correspondingly formed hinge elements of one of the longitudinal and the transverse side pieces (2, 4).

14. The shipping container in accordance with claim 13, wherein the longitudinal side pieces (2) have a snap-in engagement with the transverse side pieces (4) in an unfolded orientation.

15. The shipping container in accordance with claim 14, wherein at least one of the longitudinal and the transverse side pieces (2, 4) have insertion strips (21) arranged on top in the unfolded orientation and are insertable into corresponding insertion grooves (61) formed on an underside of the at least one cover piece (6*a*, 6*b*).

16. The shipping container in accordance with claim 15, wherein a height of the corner protrusions (1) extending past the bottom area (10) of the bottom piece (1) is sized so that the transverse side pieces (4) and the longitudinal side pieces (2) are receivable between the corner protrusions (11) in parallel orientation with respect to the bottom piece (1).

17. The shipping container in accordance with claim 16, wherein the at least one cover piece (6*a*, 6*b*) is plugged on the unfolded longitudinal and transverse side pieces (2, 4).

18. The shipping container in accordance with claim 17, wherein each of two cover pieces (6*a*, 6*b*) is pivotably fastened to one of the transverse side pieces (4).

19. The shipping container in accordance with claim 18, wherein the cover pieces (6*a*, 6*b*) are maintained on the transverse side pieces (4), pivotable around the pivot axes (S6), by hinge elements in a form of linkage heads (630) held in linkage recesses (401), wherein the hinge elements (401, 630) each is integrally molded on the cover pieces (6*a*, 6*b*) and the transverse side pieces (4).

20. The shipping container in accordance with claim 19, wherein the shipping container is made of molded foam particles of a predominantly closed foam structure of a polyolefin or a polyester.

21. The shipping container in accordance with claim 20, wherein the polyolefin is a polyethylene or a polypropylene.

22. The shipping container in accordance with claim 20, wherein the shipping container is formed of molded foam particles of an apparent density of at least 30 kg/m$^3$.

* * * * *